US008197269B2

(12) United States Patent
Cheng et al.

(10) Patent No.: US 8,197,269 B2
(45) Date of Patent: Jun. 12, 2012

(54) ELECTRICAL PROTECTION

(75) Inventors: Yung-Chi Cheng, Bade (TW); Ching-Feng Hsieh, Taipei (TW)

(73) Assignee: Askey Computer Corp. (TW)

( * ) Notice: Subject to any disclaimer, the term of this patent is extended or adjusted under 35 U.S.C. 154(b) by 0 days.

(21) Appl. No.: 12/620,099

(22) Filed: Nov. 17, 2009

(65) Prior Publication Data

US 2011/0097912 A1 Apr. 28, 2011

(30) Foreign Application Priority Data

Oct. 23, 2009 (TW) ..... 98219632 U

(51) Int. Cl.
*H01R 13/44* (2006.01)

(52) U.S. Cl. ..... 439/148; 439/135

(58) Field of Classification Search ..... 439/135, 439/148

See application file for complete search history.

(56) References Cited

U.S. PATENT DOCUMENTS

| | | | | |
|---|---|---|---|---|
| 6,183,274 | B1 * | 2/2001 | Allum | 439/135 |
| 6,552,269 | B1 * | 4/2003 | Conner | 174/67 |
| 6,565,378 | B1 * | 5/2003 | Sawayanagi et al. | 439/456 |
| 7,510,411 | B2 * | 3/2009 | Wu et al. | 439/135 |
| 2003/0027445 | A1 * | 2/2003 | Carney et al. | 439/135 |
| 2005/0020112 | A1 * | 1/2005 | De Cell et al. | 439/135 |
| 2008/0188103 | A1 * | 8/2008 | Liao | 439/135 |

* cited by examiner

*Primary Examiner* — Hien Vu

(74) *Attorney, Agent, or Firm* — Schmeiser, Olsen & Watts, LLP

(57) ABSTRACT

An electrical protection for mounting on a wire connector housing, wherein the wire connector housing comprises a fixed hole and a plurality of wire-lock apertures exposed on a top surface of the wire connector housing, and the electrical protection comprise an insulating body and an insulating protrusion located at bottom surface of the insulating body. The insulating body is used to cover the wire-lock apertures at the top surface of the wire connector housing, and the insulating protrusion is designed and constructed to fit into the fixed hole of the wire connector housing. The wire-lock apertures of the wire connector housing are all covered and insulated to prevent electrical shock from the electrical leakage through the exposed apertures.

4 Claims, 3 Drawing Sheets

ELECTRICAL PROTECTION

CROSS-REFERENCE TO RELATED APPLICATIONS

This non-provisional application claims priority under 35 U.S.C. §119(a) on Patent Application No(s). 098219632 filed in Taiwan, R.O.C. on 23 Oct. 2009, the entire contents of which are hereby incorporated by reference.

FIELD OF THE INVENTION

The present invention relates to a protecting device, and more particularly, to an electrical protection designed to protect electrical devices such as, a wire connector housing.

BACKGROUND OF THE INVENTION

Wire connector housings are widely used in various situations, either in temporary wiring or additional wiring situation. The wire connector housings are well-known in the art as being desirable or/and necessary for connecting multiple wire-connectors, such as the power wire, the signal wire, the network wire or the optical fiber, in the electronic devices, for example, the electrical control box, the signal receiver and the telecommunication equipments. Due to different applications, the structural design of the wire connector housings is various according to its wiring usage and the quantity of wires. However, the common characteristics of the wire connector housings are the wire connectors for accommodating wires or cables and the wire-lock apertures for locking the wires.

Referring to FIG. 1, a conventional wire connector housing, in which the wire connection housing 1 comprises a plurality of wire connector holes 11 and a plurality of wire-lock apertures 13 corresponding to the number of the wire connector holes 11. The wire-lock apertures 13 are provided on the top portion of the wire connector housing 1, and a plurality of screws are provided in the wire-lock apertures 13 to lock the wires. Position openings 15 are provided at the top portion of the wire connector housing 1 for positioning the wire connector housing 1. The wire connector housing 1 is fixedly positioned in the applications, such as the telecommunication equipment via the screws. When the wire connector housing 1 is installed in the telecommunication equipment, the external electrical power cable and the internal electrical power cable of the telecommunication equipment are connected in the wire connector holes 11 of the wire connector housing 1. The screws are used to lock the electrical power cables via the wire-lock apertures 13. The wire-lock apertures 13 and the position openings 15 are exposed on the top surface of the wire connector housing 1 for the technician to fitting the wires/cables into the wire connector housing 1. Safety becomes an issue in the conventional wire connector housing 1 as it can easily cause electrical shock from the electrical leakage through the holes/apertures to the user or the technician who installs or works on the wire connector housing 1. Therefore, there is a need for an electrical protection for the wire connector housing, that will be easily to install and will shield the wires/cables holes or will remind the user to switch off the electrical power before directly in contact with the wire connector housing in order to prevent the electrical shock.

SUMMARY OF THE INVENTION

In view of the aforesaid drawbacks of the prior art, it is an objective of the present invention to provide an electrical protection designed to shield the wire-lock apertures on the top surface of the wire connector housing.

Another objective of the present invention is to provide an electrical protection mounting onto a wire connector housing for reminding the user or the technician to take safety precaution.

To achieve the above and other objectives, the present invention provides an electrical protection for assembling onto a wire connector housing, wherein the wire connector housing comprises a fixed hole and a plurality of wire-lock apertures exposed on a top surface of the wire connector housing, and the electrical protection comprises an insulating body for covering the exposed wire-locked apertures, and an insulating protrusion provided at a bottom part of the insulating body is utilized for fitting into the fixed hole of the wire connector housing.

The shape and size of the insulating body are not limited to the disclosures in the preferred embodiments of the present invention, the insulating body of the electrical protection is designed and constructed to match the shape and size of the top surface of any type of wire connector housing. Therefore, the shape and size of the insulating body of the present invention is not limited to any particular shape or size. The insulating body of the present invention provides a warning label which can be embossed, impressed, craved or etched, on its top surface area. Sticker label can also be used as the warning label. Thus, the warning label provided on the top surface of the insulating body is not restricted to any specific fabrication method.

Unlike the prior art, the present invention discloses an electrical protection that can shield off and insulate the wire-lock apertures of the wire connector housing to resolve the safety concern of electrical shock through the direct human contact to the wire-lock apertures exposed on the top surface of the wire connector housing. Further, the electrical protection of the present invention provides a warning label on its top surface that can warn and remind the user or technician to take necessary safety precaution to prevent electrical shock.

DETAILED DESCRIPTION OF THE EMBODIMENT

The way of implementing the present invention is hereunder illustrated with a specific embodiment to enable persons skilled in the art to readily gain insight into the other advantages and effects of the present invention with references made to the disclosure contained in the specification.

Figure 1:
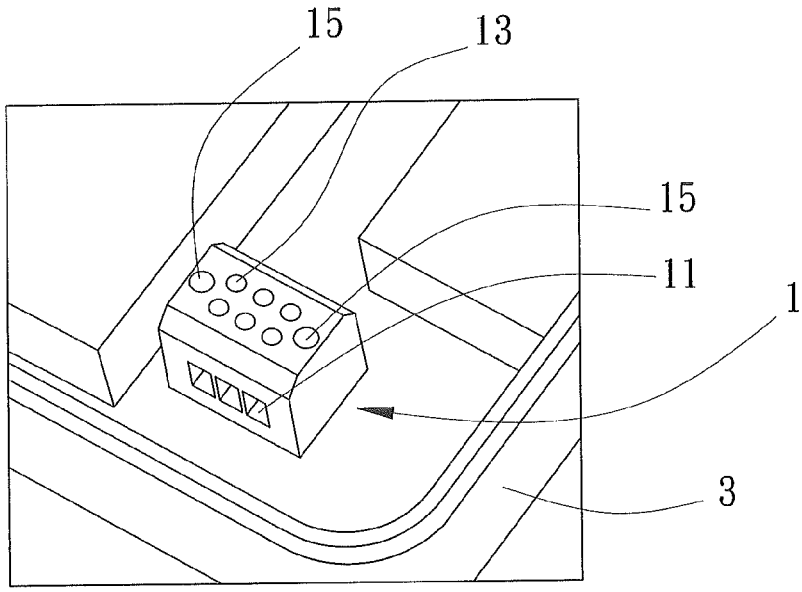
FIG. 1 (Prior Art)
FIG. 1 is a perspective view of a conventional wire connector housing.
Figure 2:
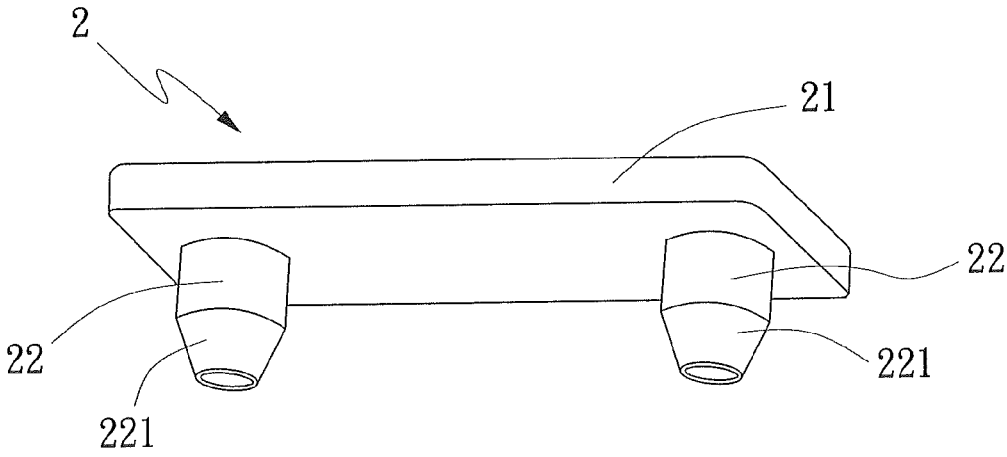
FIG. 2 is a perspective view of an electrical protection in accordance with a preferred embodiment of the present invention.
Figure 3:
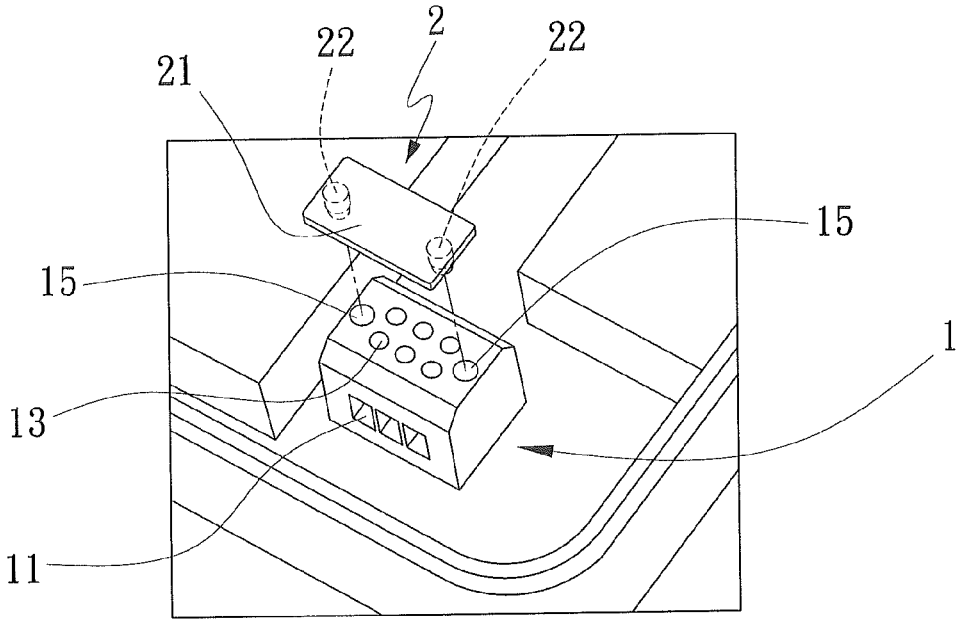
FIG. 3 is a perspective view of showing how the electrical protection is installed to a wire connector housing in accordance with the preferred embodiment of the present invention.
Figure 4:
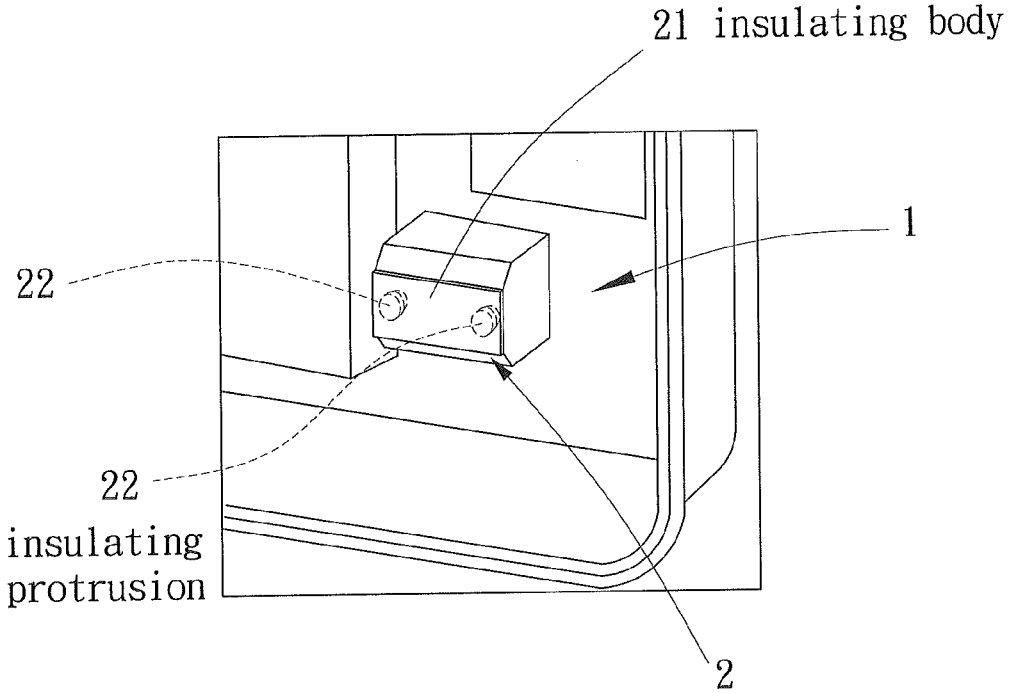
FIG. 4 is a perspective view of showing the wire connector housing with the electrical protection in accordance with the preferred embodiment of the present invention.

Referring to FIG. 2 through FIG. 4, there are perspective views of assembling a wire connector housing with an electrical protection in accordance with a preferred embodiment of the present invention. Referring to FIGS. 2-4, an electrical protection 2 is installed in a wire connector housing 1, wherein the wire connector housing 1 comprises a plurality of fixed holes 15 and wire-lock apertures 13 exposed on a top surface of the wire connector housing 1 as shown in FIG. 3. A plurality of wire connector holes 11 which are corresponding to the number of the wire-lock apertures 13 are provided in the wire connector housing 1. The structure of the wire connector housing 1 is not limited to those described in the embodiments of the present invention. The electrical protection 2 of the present invention can be designed differently in according to the various structures of the wire connector housings 1. Therefore, the disclose features of the wire connector housings 1 in the preferred embodiments are merely for illustration, and are not intended to restrict the interpretation of the claim scope of the present invention. The electrical protection 2 comprises an insulating body 21 and an insulating protrusion 22, wherein the insulating body 21 is utilized to cover all the wire-lock apertures 13 on the top surface of the wire connecting housing 1, and the insulating protrusion 22 is used to fit into the fixed hole 15.

According to the preferred embodiment of the present invention, the wire connector housing 1 comprises two fixed holes 15, and the electrical protection 2 provides two corresponding insulating protrusions 22 at its bottom part to fit into the fixed holes 15 of the wire connector housing 1. The number of the insulating protrusions 22 is not limited to two only as it can be varied according to the amount of the fixed holes 15 on the wire connector housing 1, either one, or two or many. The insulating body 21 and the insulating protrusions 22 of the electrical protection 2 can be fabricated and shaped in one piece during the integral molding process. The insulating body 21 and the insulating protrusions 22 (either one or two or a plurality of protrusion(s)) at the bottom part of the electrical protection 2.

Refer to FIG. 2, the insulating protrusions 22 in accordance with the preferred embodiment of the present invention are designed into circular-shaped rod with corn-shaped ends 221 in such that the smaller circular cross-sectional area of the corn-shaped ends 221 can be fitted into the fixed holes 15 firstly to increase the efficiency of the installation between the electrical protection 2 and the wire connector housing 1.

Figure 5:
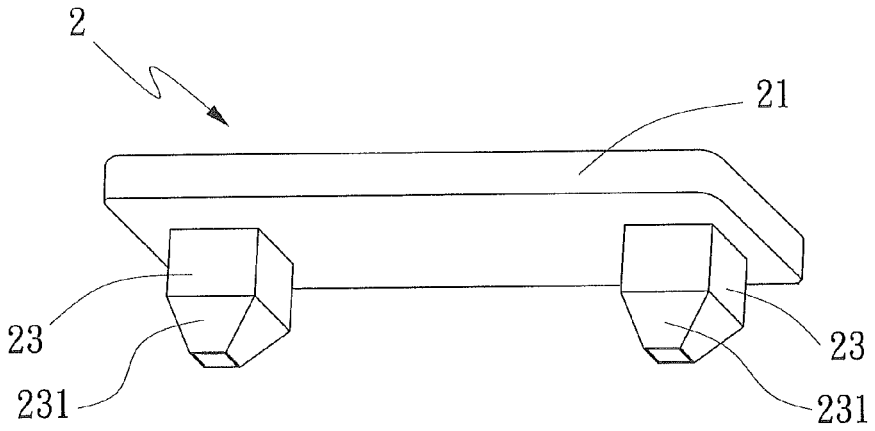
FIG. 5 is a perspective view of an electrical protection in accordance with another preferred embodiment of the present invention.

FIG. 5 shows another structural design of electrical protection in accordance with another preferred embodiment of the present invention. The insulating protrusions 23 are designed and constructed into regular polygon shapes, such as square-shaped legs, triangle-shaped legs or pentagon-shaped legs, with corn-shaped ends 231, which comprise square cross-sectional areas to improve the convenience of the installation.

The insulating body 21 is made from an insulating material, such as, rubber, polyethylene, or cork material, and its shape is designed and constructed to match to the shape of the top surface of the wire connector housing 1. FIGS. 3-4 show that the insulating body 21 is designed to correspond to the shape of the top surface of the wire-connector housing 1, which is square-shaped, so that the wire-lock apertures 13 on the top surface of the wire-connector housing 1 can be properly covered by the square-shaped insulating body 21 in order to prevent the electrical shock from occurring through the human contact to the wire connector housing 1.

Figure 6A:
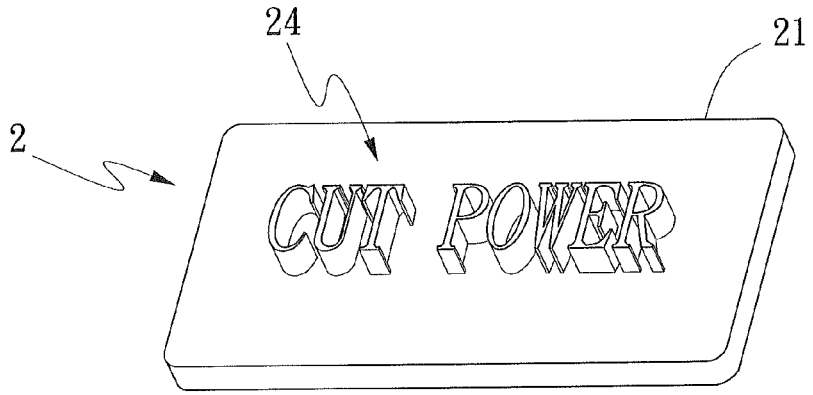
FIG. 6A is perspective view top of an electrical protection in accordance with another preferred embodiment of the present invention.
Figure 6B:
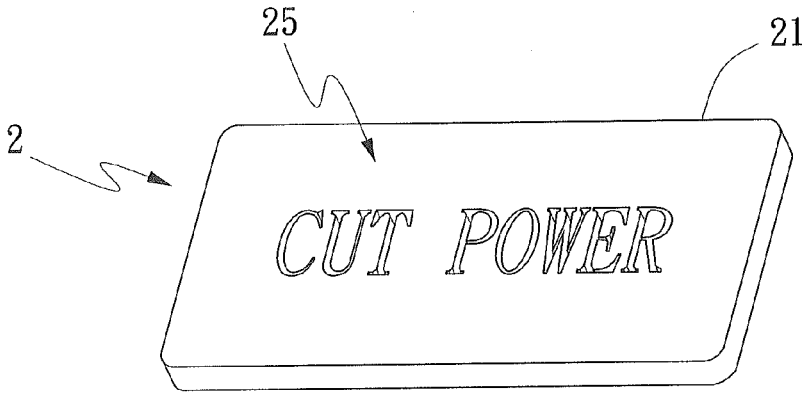
FIG. 6B is a perspective top view of an electrical protection in accordance with another preferred embodiment of the present invention.

FIGS. 6A-6B are illustrated another structural design of an electrical protection in accordance with another preferred embodiment of the present invention. Referring to FIGS. 3, 6A and 6B, the insulating body 21 of the electrical protection 2 is designed with a warning label 24 & 25, wherein the warning label 24, 25 is embossed with raised letters or impressed/etched with carved-in letters on its top surface area of the insulating body 21 to ensure that the user or the technician who works on the wire connector housing 1 will be warned and reminded to switch off the electrical power before touching the wire-lock apertures 13 of the wire connector housing 1 so that the electrical shock can be prevented.

The electrical protection 2 of the present invention utilizes its insulating body 21 to cover and insulate the wire-lock apertures 13 of the wire connector housing 1 in order to prevent the electrical shock from occurring to the user/technician. The embossed warning label 24, 25 on the top area of the insulating body 21 can warn and advice the technician or the user to take safety precaution by switching off the electrical power before working on the wire connector housing 1.

The foregoing embodiment is provided to illustrate and disclose the features and functions of the present invention and is not intended to be restrictive of the scope of the present invention. It should be understood by those in the art that many equivalent modifications and variations can be made to the aforesaid embodiment according to the spirit and principle in the disclosure of the present invention and still fall within the scope of the present invention as set forth in the appended claims.

What is claimed is:

1. An electrical protection, used for installation in a wire connector housing comprising a fixed hole and a plurality of wire-lock apertures exposed on a top surface of the wire connector housing, comprising:

a flat insulating plate, covering all of the wire-lock apertures exposed on the top surface of the wire connector housing; and an insulating protrusion, provided at a bottom part of the insulating plate and used for fitting into the fixed hole, the insulating protrusion is designed as a post;

wherein the insulating protrusion is constructed as a regular polygon-shaped leg;

wherein the regular polygon-shaped leg has a corn-shaped end;

wherein the insulating body is made from rubber, polyethylene, or cork material, and a shape of the insulating body is constructed to match to a shape of the to surface of the wire connector housing; and wherein a to surface of the insulating body comprises a warning label.

2. The electrical protection of claim 1, wherein the wire connector housing comprises a plurality of fixed holes, and a plurality of corresponding insulating protrusions are provided at the bottom part of the insulating body for fitting into an equal number of the fixed holes on the wire connector housing.

3. The electrical protection of claim 1, wherein the warning label on the top surface of the insulating body is embossed with raised letters.

4. The electrical protection of claim 1, wherein the warning label on the top surface of the insulating body is impressed with carved-in letters.

* * * * *